US007604450B1

(12) United States Patent
Calvery

(10) Patent No.: US 7,604,450 B1
(45) Date of Patent: Oct. 20, 2009

(54) TRAILER HITCH DRAWBAR HOIST ASSEMBLY

(76) Inventor: Andrew Calvery, 21921 Dorre Don Way SE., Maple Valley, WA (US) 98038

( * ) Notice: Subject to any disclaimer, the term of this patent is extended or adjusted under 35 U.S.C. 154(b) by 0 days.

(21) Appl. No.: 12/244,375

(22) Filed: Oct. 2, 2008

(51) Int. Cl.
*B66C 23/44* (2006.01)

(52) U.S. Cl. ..... 414/462; 212/180; 212/270; 414/542

(58) Field of Classification Search ..... 212/180, 212/270; 414/462, 542, 543
See application file for complete search history.

(56) References Cited

U.S. PATENT DOCUMENTS

| | | | | | |
|---|---|---|---|---|---|
| 2,487,305 | A * | 11/1949 | Bridegroom | 414/543 |
| 3,836,029 | A * | 9/1974 | Ruedebusch | 414/462 |
| 4,186,938 | A * | 2/1980 | Youngblood | 280/402 |
| 4,746,263 | A * | 5/1988 | Cook | 414/543 |
| 4,806,063 | A * | 2/1989 | York | 414/462 |
| 4,969,625 | A * | 11/1990 | Singer et al. | 248/662 |
| 5,211,526 | A * | 5/1993 | Robinette | 414/550 |
| 5,662,451 | A * | 9/1997 | Muzzi et al. | 414/540 |
| 5,690,260 | A * | 11/1997 | Aikins et al. | 224/505 |
| 5,752,799 | A * | 5/1998 | Carey et al. | 414/543 |
| 5,788,095 | A * | 8/1998 | Watson | 212/180 |
| 5,853,278 | A * | 12/1998 | Frantz | 414/462 |
| 5,857,824 | A * | 1/1999 | De Aquiar | 414/462 |
| 6,007,289 | A * | 12/1999 | Kruse et al. | 414/462 |
| 6,042,328 | A * | 3/2000 | McVaugh | 414/546 |
| 6,089,431 | A * | 7/2000 | Heyworth | 224/521 |
| 6,386,410 | B1 * | 5/2002 | Van Dusen et al. | 224/509 |
| 6,821,075 | B2 * | 11/2004 | van der Horn | 414/462 |
| 6,830,423 | B1 * | 12/2004 | Williams et al. | 414/462 |
| 6,866,285 | B1 * | 3/2005 | Stamp | 280/491.5 |
| 6,899,238 | B2 * | 5/2005 | Austin et al. | 212/270 |
| 2006/0120842 | A1 * | 6/2006 | Thompson | 414/462 |
| 2009/0120985 | A1 * | 5/2009 | Sautter et al. | 224/497 |

* cited by examiner

*Primary Examiner*—Thomas J. Brahan
(74) *Attorney, Agent, or Firm*—David L. Tingey

(57) ABSTRACT

A portable hoist for attachment to a trailer hitch drawbar includes a mast that comprises a plurality of mast segments assembled end to end in axial alignment at ground level and then rotated on a pivot bar inserted in the hitch drawbar from its horizontal assembly position to its vertical operational position. Similarly, to disassemble the hoist it is lowered from its vertical position to its horizontal position within easy reach of the user standing on the ground. The hoist boom is also installed with the mast horizontal in assembly position with the boom coaxial with the mast. The boom is then rotated to its operational position orthogonal to the mast when the mast is vertical. A friction bearing is installed on the mast so the mast above the friction bearing can rotate about the mast longitudinal axis. A winch is installed on the mast typically between the friction bearing and the boom so the winch rotates with the boom.

19 Claims, 7 Drawing Sheets

TRAILER HITCH DRAWBAR HOIST ASSEMBLY

BACKGROUND

1. Field of the Invention

This invention relates to portable hoists adapted for loading and unloading a vehicle and more specifically to hoists releasably attachable to a vehicle's trailer hitch drawbar.

2. Prior Art

It is known to have portable hoists attachable to a vehicle's trailer hitch drawbar. Typically, a hoist attaches to the drawbar with the hoist mast separated from the drawbar, leveraging a load conducted through the mast to the drawbar by the separation from the drawbar. To minimize the affect of the load on the vehicle's suspension during loading, the mast should be adjacent the drawbar. This affect is often overcome by the addition of one or more support legs between the hoist and the ground.

Portable hoists of the prior art typically comprise a plurality of components that are relatively large and heavy. The hoists are assembled in short by mounting the mast vertically in place and connecting a boom to its top. This can be at least inconvenient and unsafe. Though prior hoists may be disconnected from the vehicle hitch drawbar and therefore be portable, they remain difficult to assemble and disassemble.

An object of the present invention is to provide a hoist comprising a plurality of relatively small, lightweight components easily assembled and mounted to a vehicle trailer hitch drawbar. It is a further object that the hoist be able to be assembled and disassembled in a convenient position easily within reach from the ground and then raised to his vertical operational position. It is another object that the mast of the portable hoist be adjacent the vehicle trailer drawbar so a load on the hoist is supported by the vehicle's suspension with minimal leverage affect at the drawbar. It is a further object that the hoist be movable pivotably from one side of the vehicle to the other.

SUMMARY

These objects are achieved by a portable hoist with a straight mast comprising a plurality of mast segments connectable end to end in axial alignment. Typically, the mast comprises at least three relatively short and lightweight segments easily lifted for facile mast assembly and disassembly. The hoist is assembled near ground level horizontal from the drawbar for convenience of the user and then rotated at the drawbar from its horizontal assembly position to its vertical operational position. Similarly, to disassemble the hoist it is lowered from its vertical position to its horizontal position within easy reach of the user standing on the ground. The mast is rotated between horizontal and vertical positions on a pivot bar that connects to the hitch drawbar. A first portion of the pivot bar is square to fit entirely within the pivot bar. The second, or remaining portion of the pivot bar is cylindrical for receiving a rotatable collar to which the mast is connected. The mast is thus directly adjacent the end of the drawbar. With the drawbar mounted rearmost to the vehicle, the pivot bar extends the drawbar sufficient for the mast to clear the rear of the vehicle when it rotates between assembly and operational positions.

The hoist boom is also installed with the mast horizontal in assembly position with the boom coaxial with the mast. The boom is then rotated to its operational position orthogonal to the mast. A friction bearing is installed on the mast so the mast above the friction bearing can rotate on the mast longitudinal axis. A winch is installed on the mast typically between the friction bearing and the boom so the winch rotates with the boom. Pulleys installed with the mast in assembly position route a winch line from the winch and along the boom and hanging from the boom for attachment to a load.

In an alternative embodiment, an extension arm with a friction bearing is installed at the draw bar so the hoist is pivotably mounted to the draw bar such that the hoist can be rotated from one side of the vehicle to the other.

DETAILED DESCRIPTION OF THE PREFERRED EMBODIMENTS

Figure 1:
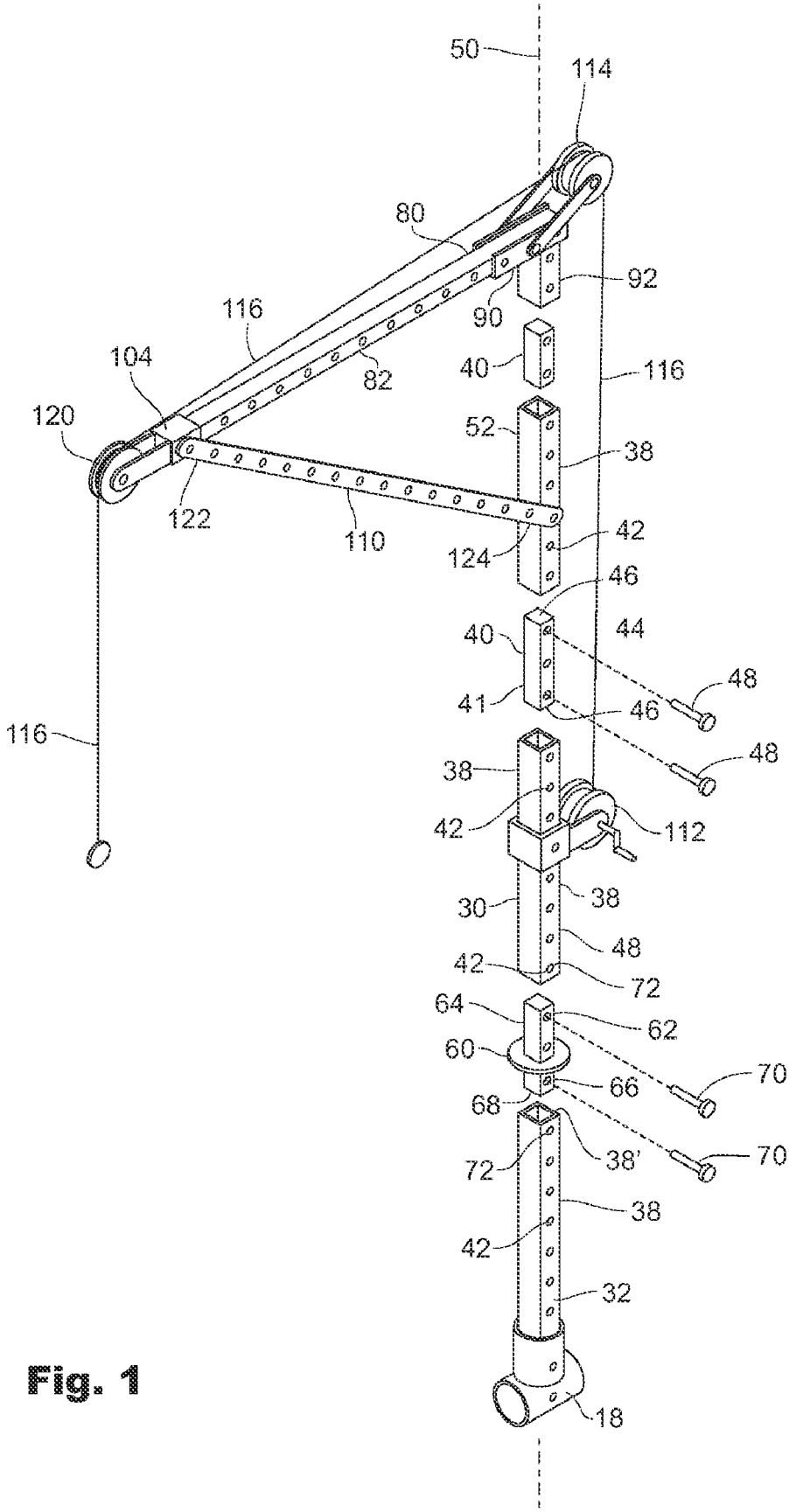
FIG. 1 is a perspective exploded view of the portable hoist assembly.
Figure 2:
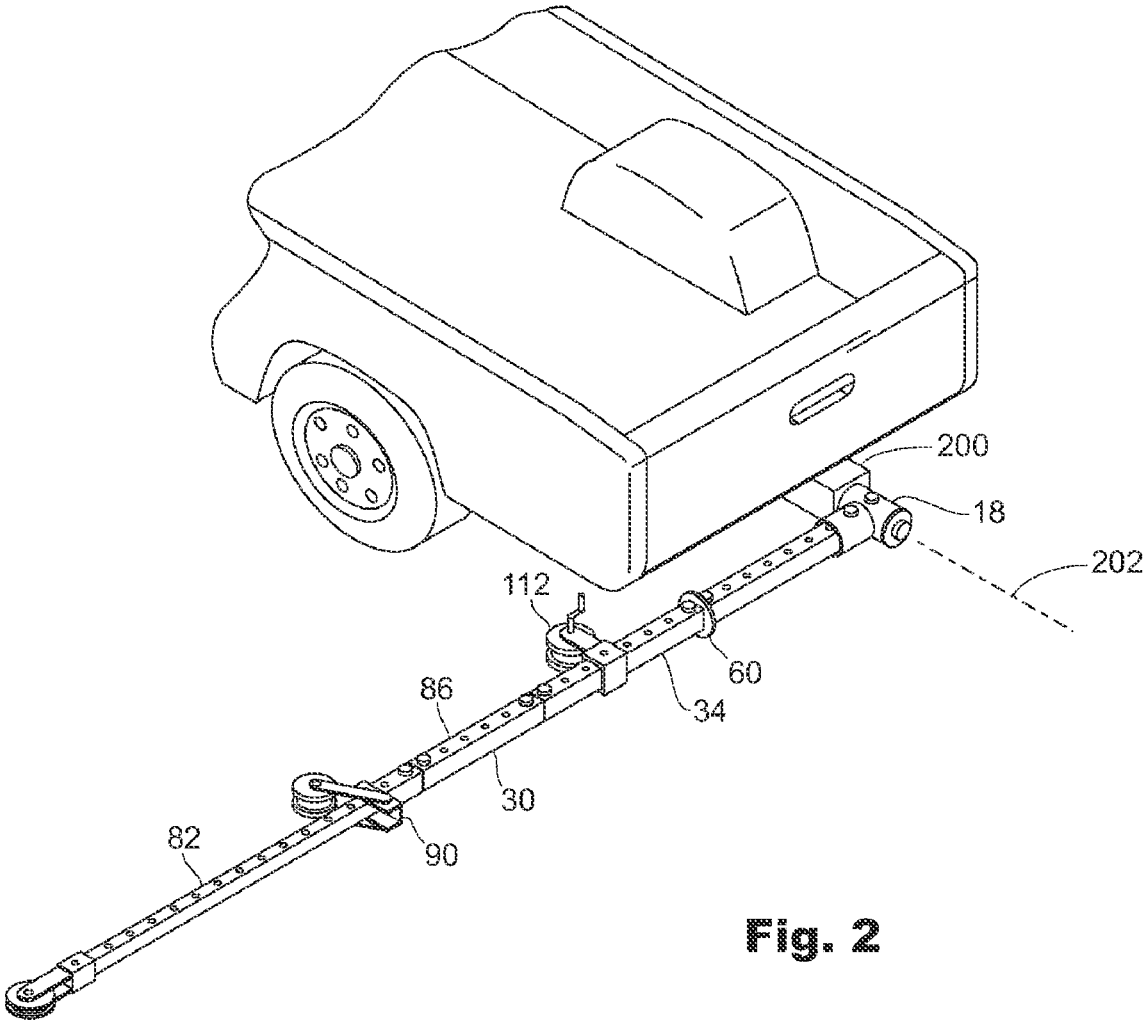
FIG. 2 is a perspective view of the hoist assembly connected to a truck at the truck trailer hitch drawbar. The hoist is shown assembled horizontal prior to rotation to vertical.
Figure 3:
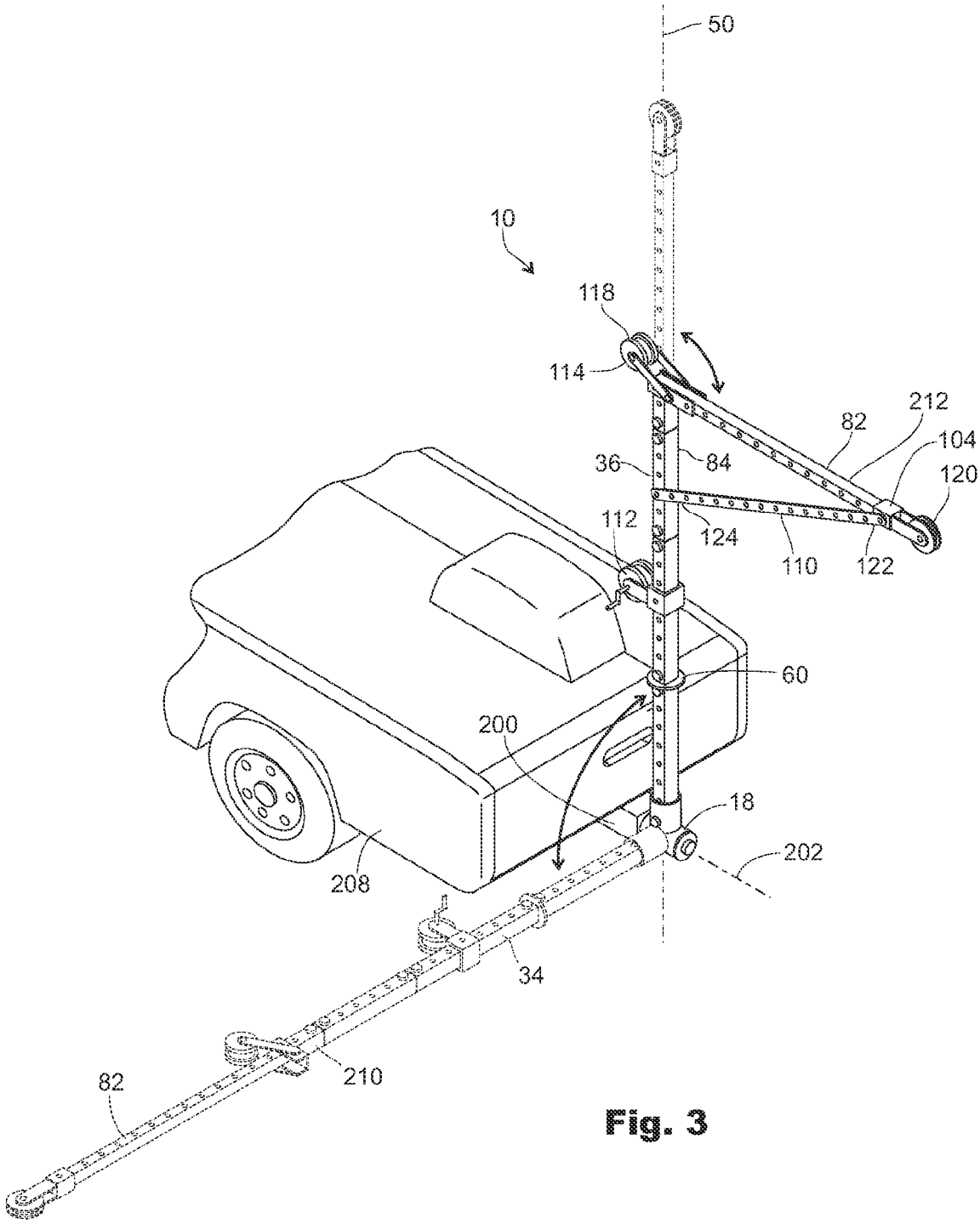
FIG. 3 is a perspective view of the hoist assembly of FIG. 2 shown rotated to vertical, and also showing the boom rotatable between coaxial with the mast and orthogonal to the mast.
Figure 4:
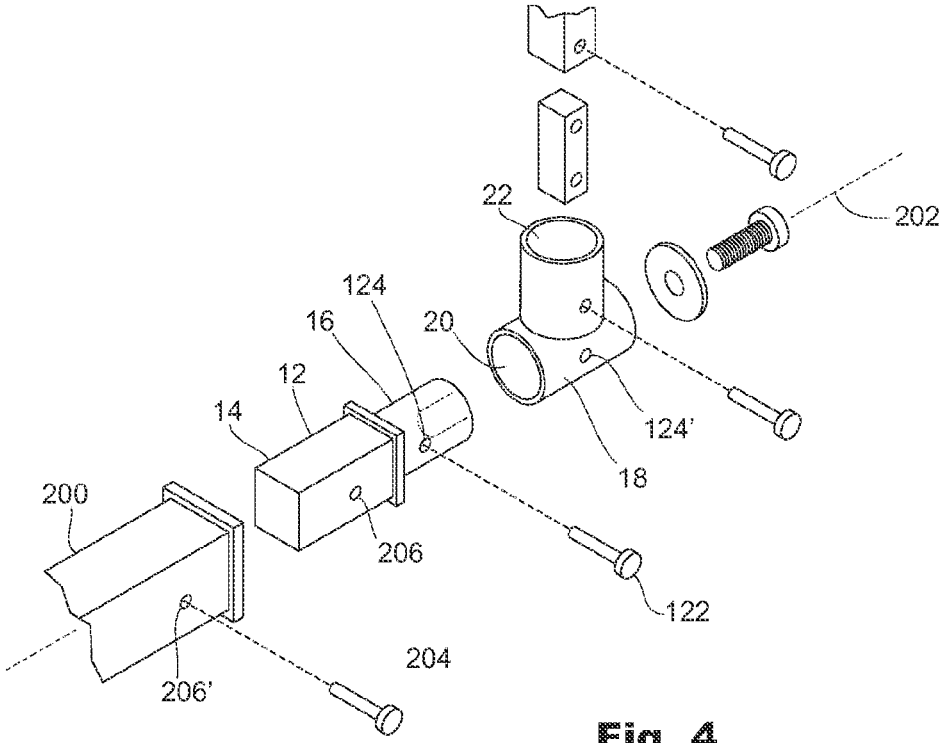
FIG. 4 is a perspective exploded view of the lower connector on a pivot bar that connects to a hitch drawbar.
Figure 5:
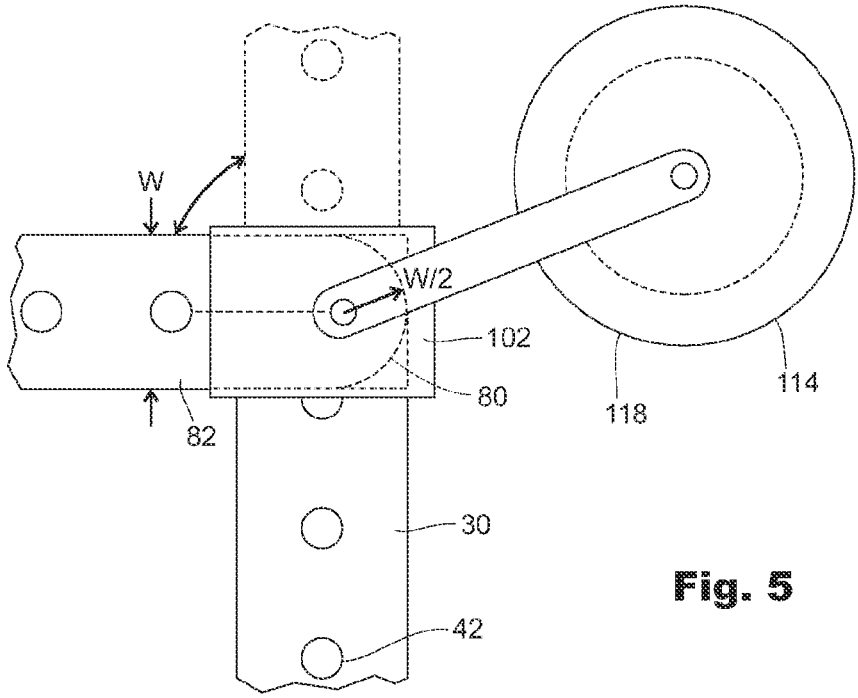
FIG. 5 is a side view of the boom connector on the mast showing boom rotation of ninety degrees.
Figure 6:
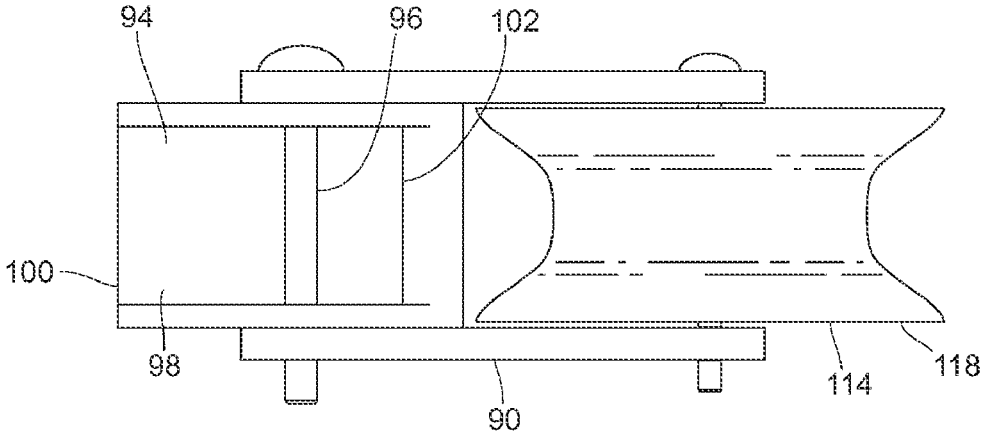
FIG. 6 is a top view of the boom connector of FIG. 5.
Figure 7:
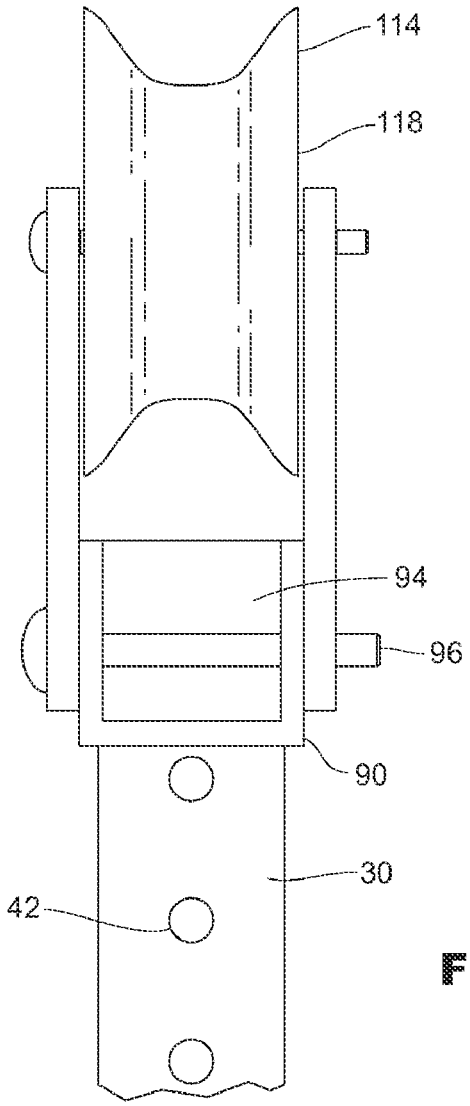
FIG. 7 is an end view of the boom connector on the mast upper end.
Figure 8:
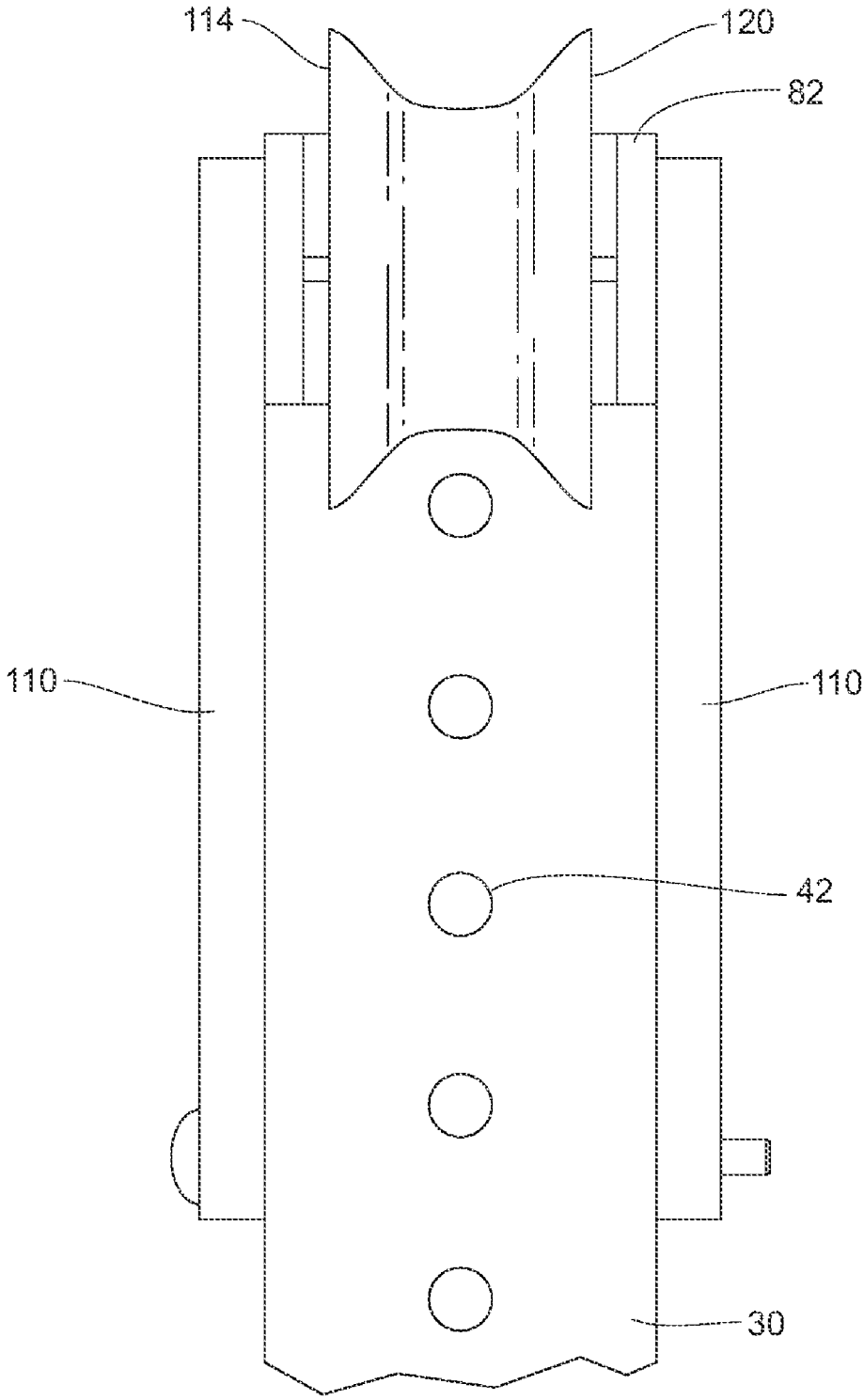
FIG. 8 is an end view of the boom distal end, also showing a brace extending to the mast.
Figure 9:
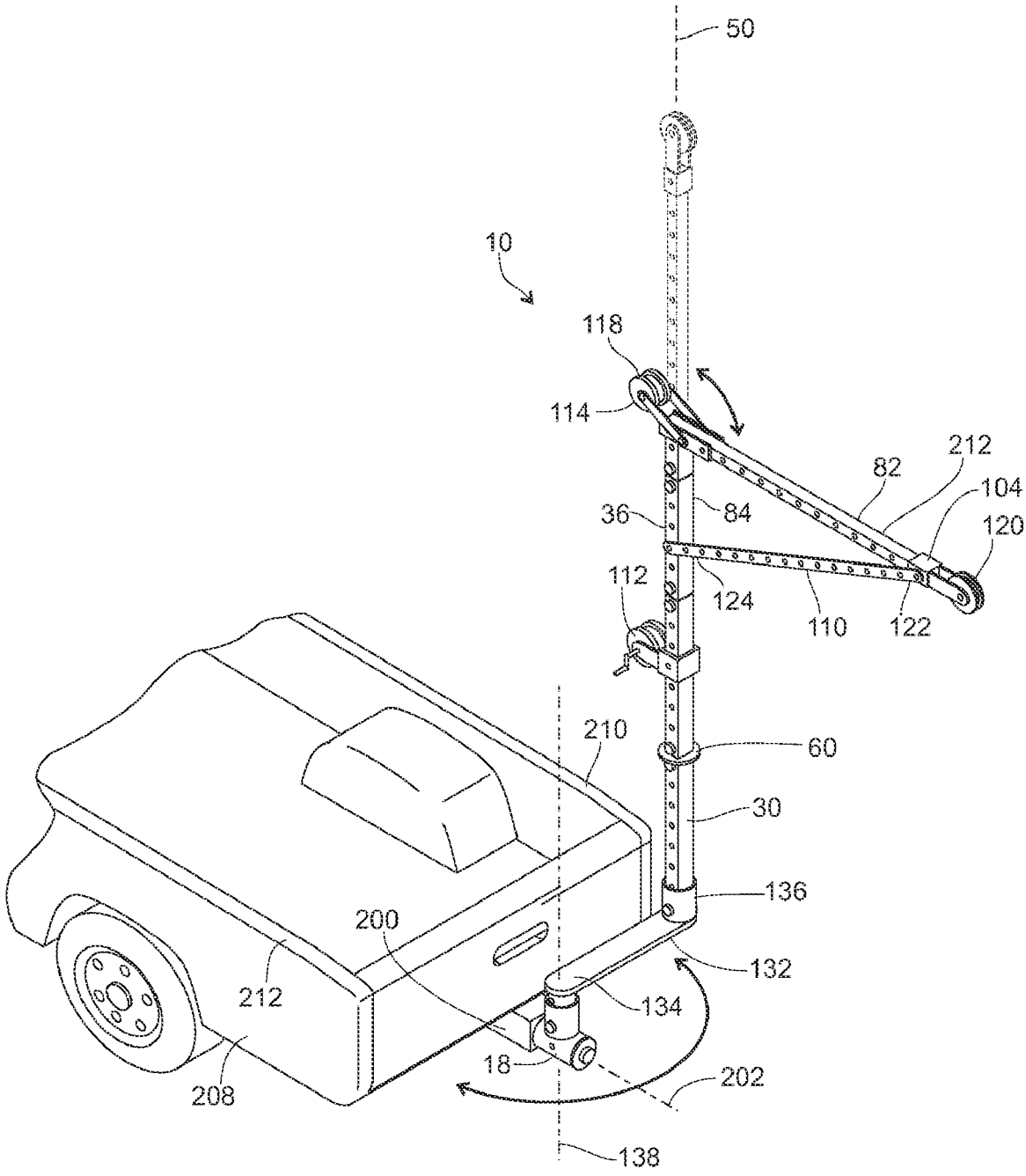
FIG. 9 is a perspective view of the portable hoist assembly further including an extension arm on a friction bearing so the hoist can be rotated from one side of the vehicle to the other.

The portable hoist assembly 10 of the present invention is adapted for attachment to a trailer hitch drawbar 200 having a longitudinal horizontal drawbar axis 202. A first portion 12 of a pivot bar 14 is adapted to insert releasably into the drawbar 200, which typically has a square cross-section. The pivot bar first portion 12 therefore typically has a matching square cross-section. A cylindrical pivot bar second portion 16 coaxial with the first portion and therefore also the drawbar 200 is adjacent the drawbar when the first portion 12 is fully received therein. A lower collar 18 with a cylindrically tubular first opening 20 releasably receives the cylindrical pivot bar second portion 16 such that the lower collar rotates 18 on the pivot bar second portion 16. The lower collar 18 also includes a second opening 22 orthogonal to the first opening 20.

A mast 30 is releasably connectable at its lower end 32 to the lower collar in the lower collar second opening 22 and is therefore rotatable with the lower collar 18 on the pivot bar 14 about the drawbar axis 202 at the trailer hitch drawbar 200 between horizontal and vertical positions 34 and 36. The mast 30 comprises a plurality of mast segments 38 mutually connected releasably by mast unions 40. The mast segments 38 include through pin holes 42 and the mast unions 40 comprise a shaft 41 with pin holes 44 in each shaft end 46 and pins 48 releasably passing through aligned mast segment and mast union pin holes in each shaft end 46 therein releasably joining together two adjacent mast segments. The portable hoist assembly 10 can then be assembled with the mast 30 horizontal within easy reach of an assembler and then rotated on the pivot bar 14 to the mast vertical position 36.

A mast friction bearing 60 divides the mast 30 with a mast upper portion 48 rotatable on the friction bearing 60 about a mast longitudinal axis 50 that intersects the pivot bar 14 near the drawbar 200. The mast friction bearing 60 similarly comprises an upper shaft 62 with at least one pin hole 64 and a lower shaft 66 with at least one pin hole 68 and pins 70 releasably passing through aligned mast segment pin holes 72 and pin holes 64, 68 in the upper and lower shafts 62, 66 therein releasably joining together two adjacent mast segments 38' and 38".

A proximal end 80 of a boom 82 releasably connects pivotably to the mast 30 between a mast operational position 84 with the boom orthogonal to the mast 30 and an assembly position 86 with the boom 82 coaxial with the mast 30 through a boom connector 90 at a mast upper end 52. The boom connector 90 releasably receives the mast upper end 52 in a boom connector mast opening 92 and the boom proximal end 80 in a boom connector boom opening 94. The pivoting boom 82 is releasably secured in the connector boom opening 94 by a boom pivot pin 96 passing through aligned holes in the boom 82 and the boom connector 90. The boom connector boom opening 94 is open above a boom-receiving trough 98 that extends from its boom end 100 receiving the boom 82 to the boom proximal end 80, past the boom pivot pin 96, that ends at a boom connector stop 102 such that the boom 82 is supported in the trough 98 when the boom 82 is orthogonal to the mast 30 in its operation position 86 and rotates out of the trough 98 on the pivot pin 96 to its assembly position 86 against the boom connector stop 102 in coaxial alignment with the mast 30. The boom proximal end 80 is semicircular with a radius approximately half the width of the boom 82 enabling the boom 82 to rotate on the pivot pin 96 that is centered in the boom width.

A brace 110 releasably connects between the boom 82 and the mast 30. A winch 112 is mounted intermediate the mast 30 typically above the friction bearing 60 so the winch 112 rotates with the mast upper portion 48. At least one pulley 114 conducts a winch line 116 from the winch 112 to a boom distal end 104 with the winch line 116 hanging from the boom arm distal end 104 for attachment to a load. Typically, a first pulley 118 releasably connects to the boom connector at the mast upper end 52 and a second pulley 120 releasably connects at the boom arm distal end 104.

In an alternative embodiment, a horizontal extension arm 132 may be mounted pivotably between the mast 30 and the lower collar 18 with an extension arm first end 134 mounted in the lower collar 18 and the mast 30 received into a extension arm second end 136 such that the mast is rotatable on the lower collar 18 about vertical axis 138 passing through the lower collar 18 such that the mast 30 is rotatable on the extension arm 132 from a first side 210 of the vehicle to a second side 212 of the vehicle.

In practice, the portable hoist 10 is transported and stored in relatively small, lightweight components easily assembled at ground level and then rotated at the hitch drawbar 200 to vertical. The pivot bar first portion 12 is first releasably inserted into the drawbar 200 and secured therein by a pin 204 passed through aligned holes 206, 206' in the pivot bar 14 and the drawbar 200. The first portion 12 of the lower collar 18 is then placed over the pivot bar second portion 16 such that the lower collar 18 rotates on the pivot bar 14. A first mast segment 38 is then releasably secured in the lower collar second opening 22 also with a pin 48 through aligned holes 42 in the components with the first mast segment 38 and the lower collar 18 rotated to its horizontal, or assembly, disposition. The remainder of the mast segments 38 are then releasably connected together end to end between the lower collar 18 at the mast lower end 32 and the boom connector 90 in axial alignment forming a straight mast 30 in horizontal disposition transverse to a vehicle 208 on which the drawbar 200 is mounted. The friction bearing 60 is releasably connected between two selective mast segments 38 in lieu of a union 40. Similarly, the winch 112 releasably connects between two mast segments 38 also in lieu of a union 40. A proximal end of boom 82 is then releasably connected to the boom connector 90 in the boom connector assembly position 210 in which the boom 82 in the boom connector 90 is in coaxial with the mast 30. The boom 82, pivotable between its boom assembly position 210 and a boom operational position 212 orthogonal to the mast 30, is first assembled in its boom assembly position 210 and then rotated to its boom operational position 212 when the mast 30 is elevated to its vertical position. The first end 122 of brace 110 is then releasably connected to the boom 82. The second end 124 of the brace 110 is then releasably connected to a brace support position intermediate the mast 30. A pulley is releasably mounted to the boom connector 90 and to the boom distal end 104 through which the winch line 116 is run such that the winch line 116 is disposed to lift and lower a load by actuating the winch 112 when the mast 30 is in its mast operational position 84. When the mast 30 is rotated to its vertical mast operational position 84, the lower collar 18 is releasably secured from further rotation by passing pin 122 through aligned holes 124, 124' in the lower collar 18 and pivot bar 14. Thus, the mast 30 in vertical disposition is rotatable on its longitudinal axis 50 on the friction bearing 60 such that the boom 82 rotates between a position outside the vehicle 208 to a position over the vehicle suitable for loading and loading a load to or from the vehicle.

The hoist assembly is similarly disassembled for transport or storage by reversing these simple steps.

Having described the invention, what is claimed is as follows:

1. A portable hoist assembly for attachment to a trailer hitch drawbar having a horizontal drawbar axis, comprising a pivot bar with a first portion adapted for releasable attachment to a trailer hitch drawbar and a cylindrical second portion at and coaxial with the drawbar, a lower collar with a first opening releasably receiving the pivot bar second portion and a second opening orthogonal to the first opening, the lower collar being rotatable on the pivot bar, a mast orthogonal to the pivot bar releasably connectable at its lower end to the lower collar at its second opening and rotatable with the lower collar on the pivot bar about the drawbar axis at the trailer hitch drawbar between horizontal and vertical positions therein enabling the portably hoist assembly to be assembled with the mast horizontal and then rotated on the pivot bar to a mast vertical position, a friction bearing dividing the mast with a mast upper portion rotatable on the friction bearing about a mast longitudinal axis that intersects the pivot bar near the drawbar, a boom with a proximal end releasably connects orthogonally to the mast at a mast upper end, a winch with a winch line, at least one pulley conducting the winch line from the winch to a boom arm distal end with the winch line hanging from the boom arm distal end for attachment to a load.

2. The portable hoist assembly of claim 1 wherein the mast comprises a plurality of mast segments mutually connected releasably by mast unions.

3. The portable hoist assembly of claim 2 wherein said mast segments include through pin holes and said mast unions comprise a shaft with pin holes in each shaft end and pins releasably passing through aligned mast segment and mast union pin holes in each shaft end therein releasably joining together two adjacent mast segments.

4. The portable hoist assembly of claim 2 wherein said mast segments include through pin holes and the friction bearing comprises an upper shaft with at least one pin hole and a lower shaft with at least one pin hole and pins releasably passing through aligned mast segment pin holes and pin holes in the upper and lower shafts therein releasably joining together two adjacent mast segments.

5. The portable hoist assembly of claim 1 further comprising a brace between the boom and the mast.

6. The portable hoist assembly of claim 1 wherein the at least one pulley comprises a first pulley at the mast upper end.

7. The portable hoist assembly of claim 1 wherein the at least one pulley comprises a second pulley at a boom arm distal end.

8. The portable hoist assembly of claim 1 wherein the winch is mounted intermediate the mast.

9. The portable hoist assembly of claim 1 wherein the winch is mounted to the mast above the friction bearing.

10. The portable hoist assembly of claim 1 wherein the pivot bar first portion comprises a square insert receivable into the drawbar bringing the pivot bar cylindrical second portion adjacent the drawbar when the pivot bar first portion is received therein.

11. The portable hoist assembly of claim 1 further comprising a pivoting boom connector at the mast upper end receiving the mast upper end in a boom connector mast opening and receiving the boom proximal end in a boom connector boom opening, the pivoting boom connector pivotable between an operational position with the boom orthogonal to the mast and an assembly position with the boom coaxial with the mast.

12. The hoist assembly of claim 11 wherein the pivoting boom is releasably secured in the connector boom opening by a boom pivot pin passing through aligned holes in the boom and the boom connector, and wherein the boom connector boom opening is open above a boom-receiving trough that extends from its boom end receiving the boom to the boom proximal end that ends at a boom connector rest such that the boom is supported in the trough when the boom is orthogonal to the mast in its operation position and rotates out of the trough on the pivot pin to its assembly position against the boom connector rest in coaxial alignment with the mast, the boom proximal end being semicircular with a radius approximately half a width of the boom enabling the boom to rotate on the pivot pin that is centered in the boom width.

13. The portable hoist assembly of claim 1 further comprising a horizontal extension arm mounted pivotably between the mast and the lower collar with an extension arm first end mounted in the lower collar and the mast received into a extension arm second end such that the mast is rotatable on the lower collar about a vertical axis passing through the lower collar such that the mast is rotatable on the extension arm from a first side of the vehicle to a second side of the vehicle.

14. A portable hoist assembly for attachment to a trailer hitch drawbar having a horizontal drawbar axis, comprising a pivot bar with a first portion adapted for releasable attachment to a trailer hitch drawbar and a cylindrical second portion at and coaxial with the drawbar, wherein the pivot bar first portion comprises a square insert receivable into the drawbar bringing the pivot bar cylindrical second portion adjacent the drawbar when the pivot bar first portion is received therein;

a lower collar with a first opening releasably receiving the pivot bar second portion and a second opening orthogonal to the first opening, the lower collar being rotatable on the pivot bar, a mast orthogonal to the pivot bar releasably connectable at its lower end to the lower collar at its second opening and rotatable with the lower collar on the pivot bar about the drawbar axis at the trailer hitch drawbar between horizontal and vertical positions therein enabling the portably hoist assembly to be assembled with the mast horizontal and then rotated on the pivot bar to a mast vertical position, the mast comprising a plurality of mast segments mutually connected releasably by mast unions, wherein said mast segments include through pin holes and said mast unions comprise a shaft with pin holes in each shaft end and pins releasably passing through aligned mast segment and mast union pin holes in each shaft end therein releasably joining together two adjacent mast segments, a friction bearing dividing the mast with a mast upper portion rotatable on the friction bearing about a mast longitudinal axis that intersects the pivot bar near the drawbar, the friction bearing comprising an upper shaft with at least one pin hole and a lower shaft with at least one pin hole and pins releasably passing through aligned mast segment pin holes and pin holes in the upper and lower shafts therein releasably joining together two adjacent mast segments a boom with a proximal end releasably connected orthogonally to the mast at a mast upper end, a winch mounted intermediate the mast with a winch line, at least one pulley conducting the winch line from the winch to the boom arm distal end with the winch line hanging from the boom arm distal end for attachment to a load, a brace between the boom and the mast, wherein the at least one pulley comprises a first pulley at the mast upper end and a second pulley at a boom arm distal end.

15. The portable hoist assembly of claim 14 wherein the winch is mounted to the mast above the friction bearing.

16. The portable hoist assembly of claim 14 further comprising a pivoting boom connector at the mast upper end receiving the mast upper end in a boom connector mast opening and receiving the boom proximal end in a boom connector boom opening, the pivoting boom connector pivotable between an operational position with the boom orthogonal to the mast and an assembly position with the boom coaxial with the mast.

17. The portable hoist assembly of claim 14 further comprising a horizontal extension arm mounted pivotably between the mast and the lower collar with an extension arm first end mounted in the lower collar and the mast received into a extension arm second end such that the mast is rotatable on the lower collar about a vertical axis passing through the lower collar such that the mast is rotatable on the extension arm from a first side of the vehicle to a second side of the vehicle.

18. A method of mounting a portable hoist to a vehicle's trailer hitch drawbar, comprising the following steps:

(a) inserting a pivot bar first portion matching the drawbar releasably into the draw bar, the pivot bar having a cylindrical second portion coaxial with the first portion brought adjacent the bar;

(b) fitting a first end of a lower collar having a cylindrical first opening releasably over pivot bar second portion such that the lower collar rotates on the pivot bar, the lower collar also having a second opening orthogonal to the first opening;

(c) connecting a first mast segment of a plurality of mast segments releasably to the lower collar second opening with the first mast segment and the lower collar rotated to a horizontal disposition;

(d) connecting said plurality of mast segments together releasably end to end in axial alignment forming a straight mast in horizontal disposition transverse the vehicle between the lower collar at a mast lower end and a boom connector at a mast upper end pivotable between an assembly position coaxial with the mast and an operational position orthogonal to the mast;

(e) connecting a friction bearing releasably between two mast segments;

(f) connecting a winch releasably between two mast segments;

(g) connecting a proximal end of boom releasably to the boom connector in the boom connector assembly position, the boom in the boom connector in axial alignment with the mast;

(h) connecting a first end of brace releasably to a boom distal end;

(i) connecting a plurality of pulleys releasably between the winch and the boom distal end;

running a winch line from the winch and through the pulleys such that the winch line is disposed to lift and lower a load by actuating the winch when the mast is in vertical disposition;

(k) rotating the mast from horizontal to vertical disposition by rotating the lower collar on the pivot bar;

(l) connecting a second end of a brace releasably to a brace support position intermediate the mast;

(m) securing the lower collar releasably in vertical disposition by passing a pin through aligned holes in the lower collar and pivot bar;

wherein the mast in vertical disposition is rotatable on its axis longitudinal with the mast on the friction bearing such that the boom rotates between a position outside the vehicle to a position over the vehicle suitable for loading and loading a load to or from the vehicle.

19. The method of claim 18 including the steps of reversing steps (a) through (m) to dissemble the portable hoist for transport or storage.

* * * * *